US009393572B2

(12) United States Patent
Binder et al.

(10) Patent No.: US 9,393,572 B2
(45) Date of Patent: Jul. 19, 2016

(54) ELECTROSTATIC SEPARATION OF A MIXTURE OF VALUABLE MATERIALS, E.G., A MINERAL SALT MIXTURE, BY MEANS OF A PIPE SEPARATOR, AND DEVICE FOR ELECTROSTATICALLY SEPARATING SUCH A MIXTURE OF VALUABLE MATERIALS BY MEANS OF A PIPE SEPARATOR, AND METHOD FOR ELECTROSTATIC SEPARATION

(75) Inventors: Kurt Binder, Kassel (DE); Frank Bock, Fritzlar (DE); Michael Krueger, Kassel (DE); Fabian Stich, Ahnatal (DE)

(73) Assignee: K+S AKTIENGESELLSCHAFT, Kassel (DE)

( * ) Notice: Subject to any disclaimer, the term of this patent is extended or adjusted under 35 U.S.C. 154(b) by 551 days.

(21) Appl. No.: 13/582,708

(22) PCT Filed: Mar. 1, 2011

(86) PCT No.: PCT/DE2011/000202

§ 371 (c)(1),
(2), (4) Date: Apr. 2, 2013

(87) PCT Pub. No.: WO2011/107074

PCT Pub. Date: Sep. 9, 2011

(65) Prior Publication Data

US 2013/0180891 A1 Jul. 18, 2013

(30) Foreign Application Priority Data

Mar. 2, 2010 (DE) ..... 10 2010 009 846

(51) Int. Cl.
*B03B 1/00* (2006.01)
*B03C 3/49* (2006.01)
(Continued)

(52) U.S. Cl.
CPC ... *B03C 3/49* (2013.01); *B03C 3/30* (2013.01); *B03C 3/62* (2013.01)

(58) Field of Classification Search
CPC ..... B03C 3/14; B03C 3/28; B03C 3/34; B03C 3/40; B03C 3/45; B03C 3/49
USPC ..... 209/4, 127.1, 127.3
See application file for complete search history.

(56) References Cited

U.S. PATENT DOCUMENTS 4,234,324 A * 11/1980 Dodge, Jr. ..... 96/99
4,477,268 A 10/1984 Kalt
(Continued)

FOREIGN PATENT DOCUMENTS

DE 1 249 181 3/1968
DE 33 34 665 10/1984
(Continued)

OTHER PUBLICATIONS

"Products of the potash industry", Chemical Technology, Processes and Products, vol. 8, 5th Edition, 2005, pp. 68-73.
(Continued)

*Primary Examiner* — Joseph C Rodriguez
*Assistant Examiner* — Kalyanavenkateshware Kumar
(74) *Attorney, Agent, or Firm* — Oblon, McClelland, Maier & Neustadt, L.L.P.

(57) ABSTRACT

The invention relates to a pipe separator (5) for electrostatically separating particles of a mixture of valuable materials, e.g., a mineral salt mixture, having different electrical charges, comprising a carrier pipe (10), wherein the carrier pipe has two field electrodes (8, 9) arranged opposite each other for generating an electric field, wherein the field electrodes (8, 9) are covered toward the inside by an insulating layer.

16 Claims, 3 Drawing Sheets

Figure 1:
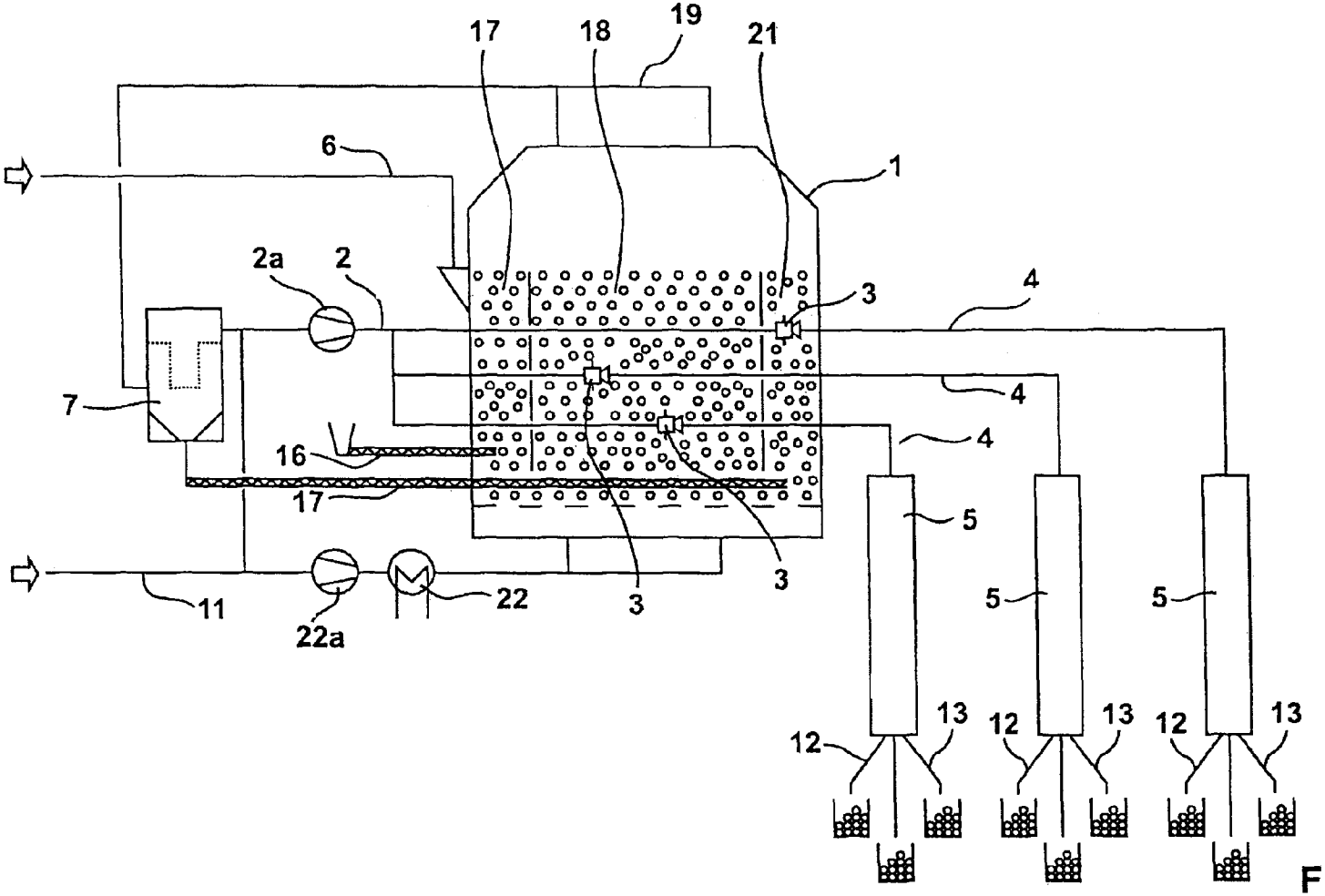

(51) Int. Cl.

| | |
|---|---|
| ***B03C 3/30*** | (2006.01) |
| ***B03C 3/62*** | (2006.01) |

(56) References Cited

U.S. PATENT DOCUMENTS

| | | | | |
|---|---|---|---|---|
| 4,628,739 | A | 12/1986 | Brueggen et al. | |
| 5,562,755 | A | 10/1996 | Fricke et al. | |
| 6,749,669 | B1 * | 6/2004 | Griffiths et al. | 96/67 |
| 2006/0081507 | A1 * | 4/2006 | Gates | 209/127.1 |
| 2008/0047434 | A1 * | 2/2008 | Kobayashi et al. | 96/95 |
| 2008/0063558 | A1 | 3/2008 | Coleman | |

FOREIGN PATENT DOCUMENTS

| | | |
|---|---|---|
| DE | 36 03 167 C1 | 3/1987 |
| DE | 43 43 625 | 6/1995 |
| DE | 195 10 116 A1 | 9/1996 |
| WO | 85 00408 | 1/1985 |
| WO | 00 61293 | 10/2000 |
| WO | 2006 026818 | 3/2006 |

OTHER PUBLICATIONS

International Search Report Issued Jun. 16, 2011 in PCT/DE11/00202 Filed Mar. 1, 2011.

* cited by examiner

ELECTROSTATIC SEPARATION OF A MIXTURE OF VALUABLE MATERIALS, E.G., A MINERAL SALT MIXTURE, BY MEANS OF A PIPE SEPARATOR, AND DEVICE FOR ELECTROSTATICALLY SEPARATING SUCH A MIXTURE OF VALUABLE MATERIALS BY MEANS OF A PIPE SEPARATOR, AND METHOD FOR ELECTROSTATIC SEPARATION

The invention concerns a tube separator for the electrostatic separation of a valuable material mixture, as well as a device for the electrostatic separation, comprising one tube separator, as well as a process for electrostatic separation.

The electrostatic separation of a valuable material mixture is implemented in an electrical field, which is formed by two field electrodes, where one field electrode is on the minus pole terminal and the other is on the positive pole terminal. The voltage is several multiples of 10,000 V, however, the current is in the mA range. The principle of electrostatic separation is usually employed in the separation of phosphates, metallic oxides, coal, plastics, but also of mineral salt mixtures. For the sorting of solid particulate matter or particles using electrostatic separation, the basic material consists of a bulk material mixture of individual particles, with different physical and chemical properties. The objective of the electrostatic separation is the pure grade separation of such a bulk material mixture.

For the electrostatic separation, the different electric charging capability of the individual particles is made use of. To achieve a maximum pure grade separation of such a valuable material mixture, the procedure is arranged at first in that the valuable material mixture is ground as fine as possible, against the background that the particles indicate a very high content of one or the other valuable material.

Usual particle sizes are in the range from 30 μm to 3,000 μm. After such a comminution of the valuable material mixture, the electrostatic charging of the individual particulate matter or particles is implemented. For that, the valuable material mixture is first conditioned and then charged tribo-electrically. Due to the different physical and chemical properties, and the corresponding conditioning, for example through the addition of reagents, individual particles are charged positively or negatively; while other particles are not provided with any charge potential.

The separation of the negatively and positively charged particles is implemented in the electrical field which, for example, is formed in a free-fall separator. In this case, the positively charged particles are attracted by the electrode which is located on the minus pole, whereas the particles which are negatively charged are attracted by the electrode on the positive pole. In addition, there are some middlings which are not attracted to either side, since the particles are not, or are not sufficiently, charged positively or negatively.

The advantage of such an electrostatic separation lies in the use of a dry separating process, and as a consequence contaminated waste water does not result, which is advantageous in particular in the area of the separation of mineral salt mixtures, particularly in case of potash manufacture.

Unlike electrostatic separation, the so-called magnetic separation (DE 195 10 116 A1) is known, where the particles of the mixture to be separated must be of ferritic origin.

This means that a separation in a magnetic field is possible only if one of the particles to be separated includes iron content, therefore is magnetic.

From DE 36 03 167 C1 it is known that the tribo-electric charging and conditioning of fine-particle salt heterogeneous mixtures are carried out in a fluidized bed with long fluidizing chamber. The disadvantage of this arrangement is that, on the transport route between the fluidized bed and the separating equipment, surface charges flow off the particles, consequently the charge density of the individual particles decreases, which has as result that the separation is implemented in the electrical field only with loss of quality.

From DE PS 12 49 181 in this connection, a ring-shaped separator is known, which is provided with a ring-shaped line with or without an ionization section, as well as a section with two electrodes basically parallel, generating an electrostatic field. The separation here is based on the principle of centrifugal force. The disadvantage here is that, due to the centrifugal forces acting on the particles, the separating result is influenced negatively.

From the reprint Winnacker·Kuechler, Chemical Technology, Processes and Products, Volume 8, 5$^{th}$ Edition "Products of the potash industry" (Wiley-VCH-Verlag GmbH & Co. KGaA), the separation in a tube freefall separator is described under the keyword "Electrostatic separation" on Page 68 ff. In this case, the valuable material mixture trickles in freefall through a high-voltage field, the positively and negatively charged particles, according to their charge, are repelled or attracted by the poles from their vertical fall direction. Particles which do not indicate any clear charge follow the vertical direction of free fall. Thus two material flows result at the end of the fall sections, which indicate the enrichment of a valuable material in each case, as well as a third material flow which does not indicate any surface potential and basically represents the valuable material mixture. The positive and minus poles of the equipment are formed as rotating tubes of electrically-conducting material.

To avoid particle lining buildup on the electrodes, and with that a weakening of the electrical field, cleaning equipment in the form of brushes is provided.

The disadvantage here is that, due to the length of the transport route and the type of transport between the process step of the tribo-electric charging and the separation in the free-fall separator, surface charges flow off the particles, consequently the separating process is implemented with loss of quality. In case of long transport routes, the insertion of further conveyor units is also necessary in addition.

Furthermore, this known free-fall separator is unsuitable for fine-grained and light particles which indicate diameters <150 μm, because not only do these materials basically not obey the laws of free fall, but they indicate a large effect in the surrounding gas. The result of this is that such fine particles are deposited on the electrodes, as a result of which the electrical field is reduced in its strength, which in the end reduces the quality of the separation. By means of the already mentioned cleaning equipment, the formation of dust linings on the electrodes can certainly be reduced, however not entirely suppressed.

In addition, increased salt adherence can cause arcing, consequently short circuits, which have as consequence that the entire free-fall separator must be shut down and ramped up again, with the further result that the cost-effectiveness of such a system decreases. Also, according to the state of the art of the technology, the separation distance between the electrodes is relatively large; in this respect a strong electrical field must be formed which makes higher voltages necessary, which are in the order of magnitude of about 100,000 V. While the currents are relatively small in the mA range, considerable power is still required however.

The task underlying the invention is that it provides one tube separator, as well as an equipment item with a tube separator, as well as providing a process which works with the aid of such equipment, with which the separating result should be significantly increased with a comparatively low level of capital expenditure. Furthermore, the equipment should be equally suitable both for the fine grain spectrum and for the coarse grain spectrum, The subject of the invention in this respect is primarily a tube separator for the electrostatic separation of differently electrically-charged particles of a valuable material mixture, e.g. of a mineral salt mixture, comprising a support tube, where the support tube indicates two field electrodes arranged opposite each other for the formation of an electric field, where, according to the invention, it is planned that the field electrodes are covered internally by an insulation layer, which means in the direction of the inside of the pipe. Such an insulation layer, formed as a dielectric, consists e.g. of glass.

It has already been demonstrated at another point that the disadvantage of the traditional separator is such that, due to the direct arrangement of the field electrodes in the flow of the recycling material particles to be separated, there results particles adhering to the electrodes. This causes the field strength to decrease. Furthermore, this causes that the separating result becomes impaired, where, as already explained at another point, the electrodes must be cleaned by rotating brushes at pre-determined intervals, where the time interval between two cleaning processes is basically determined through the particle size of the valuable material mixture to be separated. That is, dust-forming particles result as adherence on the electrode rather than large, heavy particles.

The covering of the electrodes through an electrically non-conducting layer does guarantee that the particles suspending in the supply flow are deflected, according to their charge, to the positive pole or to the minus pole of the corresponding electrode, but do not adhere to the inner jacket surface of the separator, or however, at least the level of adherence is decreased. Particles without charge potential follow the flow thread of the solid matter-gas mixture and are discharged in the middle of the tube separator.

As a result of the utilization of a dielectric or a non-conducting coating on the electrode, such adherence, as described above, are avoided to a large extent. The result of this is that the field strength can be proportionally decreased, since the field strength, as with the state of the art of the technology, does not decreases due to salt deposits, and insofar must be compensated by a higher field strength. In this respect, the separating result is significantly better with respect to the state of the art of the technology.

The field electrodes formed in circular design are advantageous with this implementation form, arranged in the pipe jacket of the tube separator, where the pipe jacket, as already detailed, is formed from a dielectric such as e.g. glass.

Another variant is characterized in that the support tube formed from e.g. glass indicates the field electrodes on the outer jacket surface of the pipe.

In order to achieve a separation of the central flow from the particles deflected by the positively or negatively charged electrodes, the tube of the tube separator indicates two separator tongues at the lower end, in order to separate the solid matter flows.

The subject of the invention is likewise a device for the electrostatic separation of particles differently electrically-charged from a valuable material mixture, e.g. a mineral salt mixture, comprising one tube separator of the described type where, according to the invention, an equipment item, in particular a so-called fluidized-bed packed-bed apparatus, is provided in which the valuable material mixture to be separated is conditioned, whirled up by a gas flow and as a result tribo-electrically charged, where the fluidized-bed packed-bed apparatus is connected directly by at least one tube to the tube separator, where the solid matter-gas mixture is conveyed through at least one tube to the tube separator with a specified flow velocity.

An essential feature in the development of the equipment for the electrostatic separation is that the solid matter-gas mixture is conveyed directly to the tube separator from the turbulence process, therefore as it were in the suspension status of the solid material particles. This occurs against the following background:

From the state of the art it is known that the valuable material mixture is first of all to be ground and conditioned, in order to charge the individual particles then tribo-electrically. A mixture treated in such a way is usually conveyed as bulk material to the free fall separator. The conveyance of the bulk material is also frequently implemented in metallic continuous mechanical-handling equipment, which causes the charge density of the individual particles to be decreased, since the charges in part migrate over adjacent particles, however, also for example over the above-described continuous mechanical-handling equipment of metal. The result of this is that, when the solid matter mixture is conveyed to the free-fall separator, due to the smaller charge density on the particles, a sufficiently good separation cannot be achieved.

As a result solid matter-gas mixture being conveyed to the tube separator immediately after the tribo-electric charging, a decrease of the charge density basically does not occur.

Furthermore, the subject of the invention is that the solid matter-gas mixture is conveyed to the tube separator with a pre-determined flow velocity.

With the operation of a free-fall separators, according to the state of the art of the technology, it happens that the flow velocity of the mixture is very low with the intake into the free-fall separator. The speed increases in the course of the passage of the individual particles through the free-fall separator. This increasing speed of the individual particles over the length of the free-fall separator has the effect that, in case of a specified field strength, the deposition rate of the finest particles on the electrode increases. This occurs because, in case of a material which is especially fine thus indicating a diameter of <150 μm, the air resistance is so great in comparison to the gravitational force that these particles, since they are held as it were in suspension status, are deposited on the electrodes and lead to problems there, which have already been explained at another location.

If the solid matter-gas mixture is now conveyed to the tube separator with an increased velocity, thus for example with a flow velocity of 10 m/s, then this means that basically no differential speeds exist between the gas, on the one hand, and the particles on the other hand. Force influences due to aerodynamic resistance, in particular in case of fine-grained particles, are basically eliminated in this respect. However, this also means that the same conditions prevail over the length of the tube separator, which means that the field strength between the electrodes can be set-adjusted to an optimal value.

A further advantage of the increased speed of the particle flow in the tube separator is that the flow is turbulent in the edge zone of the tube separator, which causes a type of automatic cleaning of the inner jacket, and consequently the danger of adherence is further decreased. This also means that the cross section of the separator can be decreased, i.e. the distance between electrodes decreases which is why, in case of similar separator capacity, lower voltages are necessary, which in turn reduces the danger of adherence on the inner jacket.

As already explained at other location, the state of the art of the technology is such that the particles, and here in particular small-grain particles with a diameter <150 μm, due to the field strength are deposited directly on the inner jacket surface of the free-fall separator, and in particular in the upper area of the free-fall separator. The incidence of solid material particles on the inner jacket surface always causes wear.

The vertical incidence of solid material particles on the inner jacket surface is held low by the directed flow due to the specified flow velocity, and insofar decreases the wear. This means that a high level of durability of the tube separator is achieved. It is to be noted in particular that saline mixtures are strongly abrasive, from which the advantage of the incorporation of the solid matter-gas mixture with a directed flow through an increased flow velocity is manifestly obvious.

The equipment, in particular the fluidized-bed packed-bed apparatus, is provided in each individual case with at least two chambers, where the conditioning of the particulate matter or particles is implemented in the first chamber. The conditioning of the individual particles is implemented for example through the addition of a conditioning agent. In the second chamber, the turbulence of the solid matter-gas mixture is implemented for the purpose of the tribo-electric charging of the particles.

For the direct discharge of the particles, at least one injector nozzle is provided in the second chamber in order to convey the solid matter-gas mixture to the tube separator through a particularly straight-running pipe, in which further tribo-electric charging is implemented. This means that the tube separator is provided with the solid matter-gas mixture directly from the turbulence chamber, the second chamber. A straight-running pipe has the advantage that the loss of charge of the tribo-electrically charged particles is minimized since, unlike a curved tube, the particles have a low level of contact with the pipe which is usually electrically-conducting. The pipe can be as short as desired.

This is in contrast to the state of the art of the technology, where the free-fall separator is provided with the solid matter mixture as bulk material in the continuous mechanical-handling equipment.

Furthermore, the fluidized-bed packed-bed apparatus is provided with a third chamber, where, with the third chamber, a valuable material lean mixture from the filtering system can be supplied to the fluidized-bed packed-bed apparatus, and the third chamber has at least one injector nozzle in order to provide the tube separator with the valuable material lean mixture. The tube separator, which is provided with this lean mixture, can be especially set-adjusted for this granulation.

All chambers are linked in communication with each other. However, this means that the particles are mixed with each other continuously in the individual chambers, which means, in particular with respect to the valuable material lean mixture, that this concentrates to a pre-determined extent in the downstream third chamber. The individual injector nozzles are adjustable with respect to the particle size of the particles of the valuable material mixture to be taken up, i.e. a geometrical setting-adjustment of the injector nozzles is implemented with regard to the particles in the tube separator to be removed. In this way, the tube separator can be provided with comparatively small-sized particles.

Also the subject of the invention is a process for the electrostatic separation of differently-charged particles of a valuable material mixture, e.g. of a mineral salt mixture, with the aid of an equipment item of the afore-described type. In this case, the tube separator is provided with the valuable material mixture immediately after the conditioning and the tribo-electric charging, with the aid of the gas flow, in the mixed status with a predetermined flow velocity, from the turbulence chamber to the tube separator, where the flow velocity at the intake of the tube separator corresponds to that at the discharge. An advantage here is that the flow velocity, with which the valuable material-gas mixture is given up to the tube separator, is adjustable, dependent, on the one hand, on the length of the tube separator and, on the other hand, on the inner diameter of the tube separator.

By means of the drawings, the invention is explained in more detail in the following as examples.

Figure 1A:
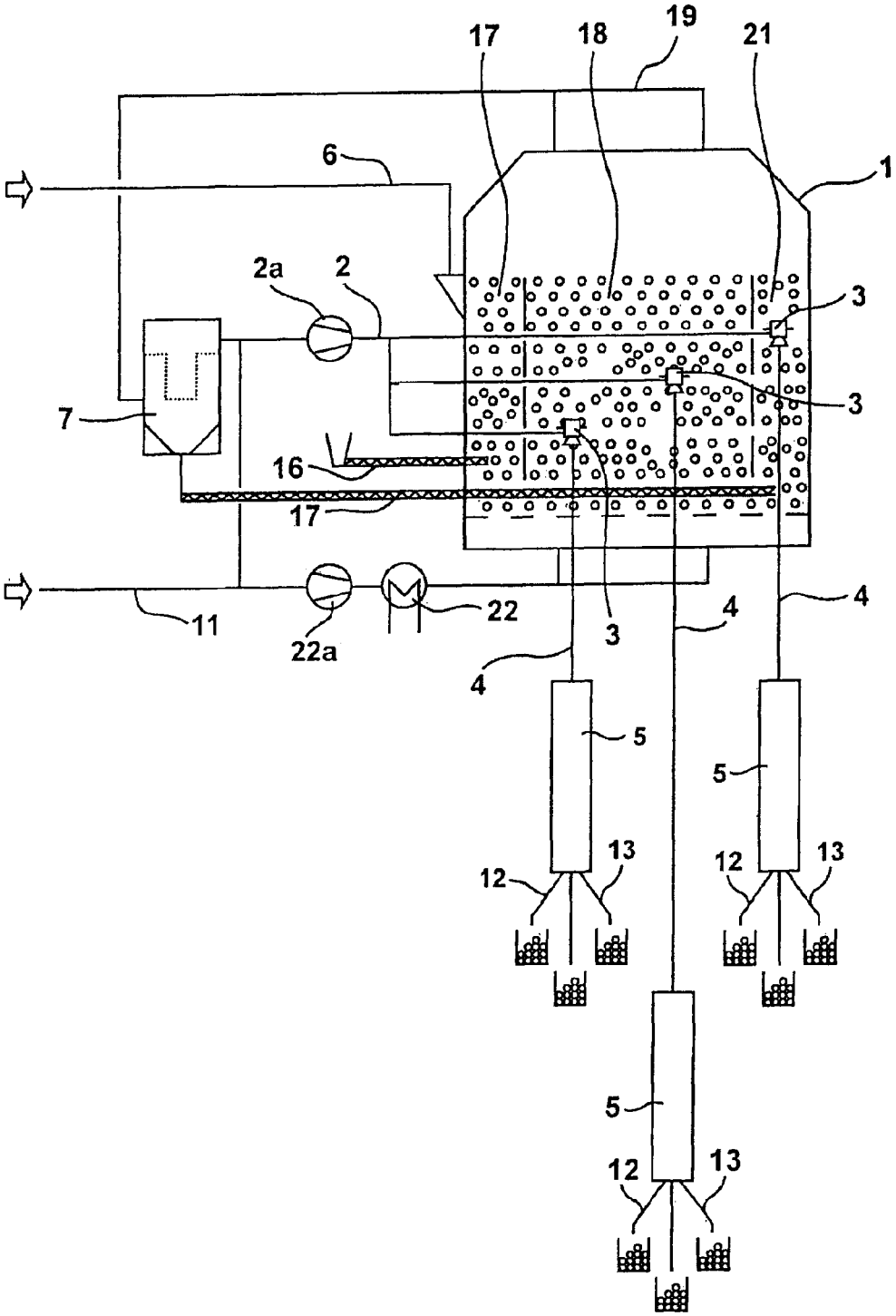
Figure 2:
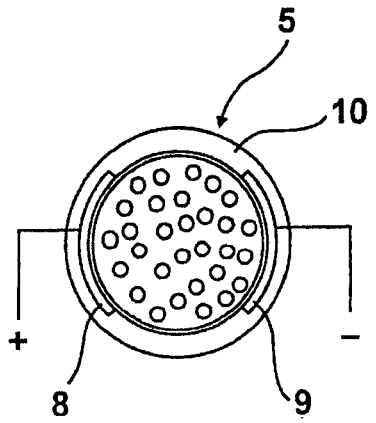
Figure 3:
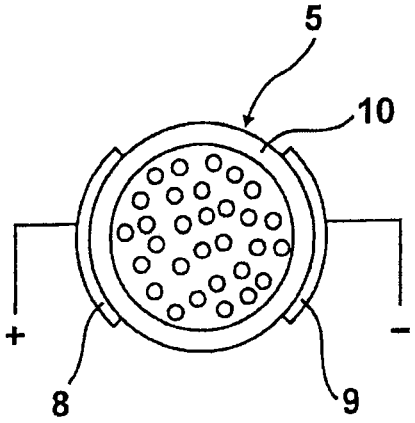
Figure 4:
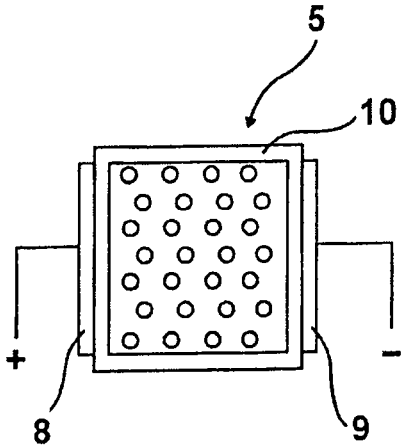

FIG. 1, FIG. 1*a* Indicate the fluidized-bed packed-bed apparatus with downstream tube separators;

FIG. 2-FIG. 4 Indicate different design forms and structuring of the tube separator.

The fluidized-bed packed-bed apparatus represented in FIGS. 1 and 1*a* with 1 includes the three chambers 17, 18 and 21. The task of the valuable material mixture, e.g. of a salt mix, is implemented through line 6 into the so-called first chamber, the conditioning chamber. In this chamber 17 is implemented also the supply of reagents through line 16. Line 16 is laid in the ground area of chamber 17. Gas e.g. air is introduced through line 11 into the chamber 17, 18, 21. possibly via heat exchanger 22 with the aid of a blower 22*a*.

This gas, in particular air, ensures turbulence and thus a tribo-electric charging of the individual particles of the valuable material mixture. At the upper end of the fluidized-bed packed-bed apparatus one or more outflows 19 are provided, in order to carry off the finest particles with the gas flow into filter 7. The size of the particles routed out is dependent on the strength of the air flow stream, which is conveyed through line 11. With stronger flow, correspondingly larger particles are also delivered through the line. From filter 7, these filtered-off particles of chamber 21 of a pre-determined size are supplied into the fluidized-bed packed-bed apparatus. As a result of the feedback of the finest particles into section 21 of the equipment Item 1, the process parameters of the solid matter-gas mixture and the electrical field strength in the tube separator can be adapted process-related for the separation of the large particles from chamber 18 and the finer particles from chamber 21.

As explained already at other location, the individual chambers 17, 18 and 21 are linked in communication with each other. This causes a continuous mixing through of the individual particles within the fluidized-bed packed-bed apparatus. 3 injector nozzles are arranged in chamber 18 and in chamber 21, which are fed from the air stream 2 through the blower 2*a* from filter 7. The utilization of this gas flow has advantages for the supply of the injector nozzles 3, in that this gas flow, because of the fact that it was already in equipment Item 1, is concentrated with reagents for the conditioning, which ensures further tribo-electric charging of the particles with transport through the pipes into the tube separator.

The two injector nozzles within the turbulence chamber 18 are connected directly with the two tube separators 5 through pipes 4. A further injector nozzle 3 is in chamber 21, and routes the mainly fine particles to a further tube separator 5.

With the representation in accordance with FIG. 1*a*, unlike FIG. 1 the respective tube separator 5 is connected with the injector nozzles 3 through pipes 4 which have no bends or curves, such that the loss in charge of the tribo-electrically charged particles is minimized.

The solid matter-gas mixture, which is conveyed by the injector nozzles 3 to the tube separators 5, enters the tube separator with a pre-determined velocity, for example 10 m/s. The flow velocity here is basically constant over the length of the tube separator. At the lower end are located separator tongues 12, 13, which ensure a discharge of the positively charged particles and also the negatively charged particles, as well as some middlings.

The subject of FIGS. 2-4 is the arrangement of the field electrodes 8, 9 on the wall of the support tube 10 of the tube separator. In accordance with FIG. 2, the field electrodes 8, 9 are arranged in the jacket of the tube separator. The jacket of the tube separator is formed as a dielectric, e.g. glass.

With the representation in accordance with FIG. 3, the circular-shaped electrode is located on the outer jacket of the glass tube 10 of the tube separator. The development in accordance with FIG. 4 shows only a quadratic pipe of a tube separator with outside-seated field electrodes 8, 9.

The invention claimed is:

1. An equipment for electrostatic separation of differently electrically-charged particles of a valuable material mixture, comprising:

a tube separator, for electrostatic separation of differently electrically-charged particles of a valuable material mixture, said tube separator comprising;

a support tube, wherein the support tube comprises two field electrodes arranged near each other for the formation of an electric field, and the field electrodes are covered internally by an insulator layer, wherein an equipment item, in which the material mixture to be separated is conditioned and mixed through a turbulent gas flow and is tribo-electrically charged, and wherein the equipment item is connected through at least one pipe directly with the tube separator, wherein a solid matter-gas mixture is conveyed with a specified speed through the at least one pipe to the tube separator, wherein the equipment item is provided with at least a first and a second chamber, wherein a conditioning of the particles of the material mixture is implemented in the first chamber, wherein in the second chamber, at least one injector nozzle is provided, in order to supply the tube separator with a solid matter-gas mixture directly through the at least one pipe, wherein the at least one injector nozzle is adjustable with respect to the particle size of the particles of the valuable material mixture to be taken up.

2. The equipment according to claim 1, wherein the support tube is comprises an electrical insulator wherein the field electrodes are arranged in a pipe jacket.

3. The equipment according to claim 2, wherein the electrical insulator is glass.

4. The equipment according to claim 1, wherein the support tube is formed as an insulator, wherein the field electrodes are arranged on an outer jacket surface of the support tube.

5. The equipment according to claim 1, wherein the support tube of the tube separator comprises two separator tongues at the lower end, in order to separate solid matter flows.

6. The equipment according to claim 1, wherein in the second chamber, a turbulent mixing of the particles of the material mixture is implemented through a supply of a gas flow.

7. The equipment according to claim 1, wherein a third chamber is provided, wherein a valuable material lean mixture can be supplied to the third chamber, wherein the third chamber comprises at least one injector nozzle in order to convey the valuable material lean mixture directly to tube separator through the at least one pipe.

8. The equipment according to claim 7, wherein the first, second, and third chambers are connected directly communicating with each other.

9. The equipment according to claim 1, wherein the at least one pipe is formed in a straight run.

10. The equipment according to claim 1, wherein the material mixture is a mineral salt mixture.

11. The equipment according to claim 1, wherein the equipment item is a fluidized-bed packed-bed apparatus.

12. A process for electrostatically separating differently-charged particles of a valuable solid material mixture, with the aid of an equipment item according to claim 1, the process comprising:

conditioning and tribo-electrically charging the solid material mixture, and subsequently immediately routing the solid material mixture, with the aid of a gas flow, directly out of a turbulence state, with a pre-determined flow velocity, to the tube separator, wherein a flow velocity of the solid matter-gas mixture at an intake of the tube separator corresponds approximately to a flow velocity at a discharge of the tube separator.

13. The process according to claim 12, wherein the flow velocity, with which the solid matter-gas mixture is given up the tube separator, is dependent on a length of the tube separator and an inner diameter of the support tube of the tube separator.

14. The process according to claim 12, wherein the material mixture is a mineral salt mixture.

15. The process according to claim 12, wherein the equipment item is a fluidized-bed packed-bed apparatus.

16. The process according to claim 12, wherein the equipment item is connected through at least one pipe directly with the tube separator, wherein a solid matter-gas mixture is conveyed with a specified speed through the at least one pipe to the tube separator.

* * * * *